US009308565B2

(12) United States Patent
Giusti

(10) Patent No.: US 9,308,565 B2
(45) Date of Patent: Apr. 12, 2016

(54) METHOD FOR OBTAINING AN OPENING IN A HOLLOW-BODY MEMBER, AND A HOLLOW-BODY MEMBER PROVIDED WITH ONE OR MORE OPENINGS OBTAINED WITH SAID METHOD

(75) Inventor: Dino Giusti, Conegliano (IT)

(73) Assignee: GI. DI. MECCANICA S.P.A., Treviso (IT)

( * ) Notice: Subject to any disclaimer, the term of this patent is extended or adjusted under 35 U.S.C. 154(b) by 305 days.

(21) Appl. No.: 13/388,678

(22) PCT Filed: Aug. 5, 2009

(86) PCT No.: PCT/IT2009/000364

§ 371 (c)(1),
(2), (4) Date: Feb. 3, 2012

(87) PCT Pub. No.: WO2011/016065

PCT Pub. Date: Feb. 10, 2011

(65) Prior Publication Data

US 2012/0135264 A1 May 31, 2012

(51) Int. Cl.
*B21D 26/035* (2011.01)
*B21D 28/28* (2006.01)

(52) U.S. Cl.
CPC ..... *B21D 26/035* (2013.01); *B21D 28/28* (2013.01); *Y10T 428/12361* (2015.01)

(58) Field of Classification Search
CPC .... B21D 26/02; B21D 26/021; B21D 26/029; B21D 26/031; B21D 26/035; B21D 26/047; B21D 28/28; B21D 26/023; B21D 28/24; B21D 28/243; B21D 28/34
USPC ..... 72/55, 58, 61, 370.22, 370.27; 83/53, 83/54, 22, 177; 29/421.1
See application file for complete search history.

(56) References Cited

U.S. PATENT DOCUMENTS 2,238,212 A * 4/1941 Cornell, Jr. ..... 72/58
2,732,897 A * 1/1956 Musser ..... 83/177

(Continued)

FOREIGN PATENT DOCUMENTS

DE 198 09 519 7/1999
DE 19935714 A1 * 2/2001 ..... B21D 22/10

(Continued)

OTHER PUBLICATIONS

International Search Report Issued Feb. 18, 2010 in PCT/IT09/00364 Filed Aug. 5, 2009.

*Primary Examiner* — Edward Tolan
(74) *Attorney, Agent, or Firm* — Oblon, McClelland, Maier & Neustadt, L.L.P.

(57) ABSTRACT

The present invention refers to a method for obtaining an opening (8) in a hollow-body member (3) having a longitudinal extension and a cavity (6), and to a hollow-body member (3) provided with one or more openings (8, 9) obtained with the above-mentioned method, which includes the following phases: a. predisposing a holding die (12) including a seat (17) countershaped with respect with said hollow-body member (3) and an ejection channel (13) having a first end (18) communicating with said seat (17) and a second ejection end (19); b. inserting and positioning the hollow-body member (3) in the seat (17) so that said first end (18) is arranged in correspondence with a wall portion of said hollow-body member (3) on which to obtain an opening (8); c. generating a progressively increasing pressure inside said cavity (6) sufficient to deform said wall portion (16) to a point of detaching it from the hollow-body member (3) to form said opening (8), and expelling the wall portion (16) along the ejection channel (13).

18 Claims, 9 Drawing Sheets

(56) References Cited

U.S. PATENT DOCUMENTS

| | | | | | |
|---|---|---|---|---|---|
| 3,158,119 | A | * | 11/1964 | Thaller et al. | 72/364 |
| 3,495,486 | A | * | 2/1970 | Fuchs, Jr. | 83/53 |
| 3,646,653 | A | * | 3/1972 | Richard | 29/896.32 |
| 3,991,456 | A | * | 11/1976 | Lieser | 29/890.132 |
| 5,398,533 | A | * | 3/1995 | Shimanovski et al. | 72/55 |
| 5,816,089 | A | * | 10/1998 | Marando | 72/55 |
| 5,996,455 | A | * | 12/1999 | Haag et al. | 83/54 |
| 6,006,566 | A | | 12/1999 | Huelsberg et al. | |
| 6,067,830 | A | * | 5/2000 | Klages et al. | 72/55 |
| 6,751,994 | B2 | * | 6/2004 | Horton et al. | 72/55 |
| 7,464,571 | B2 | * | 12/2008 | Uchida | 72/55 |
| 2003/0221468 | A1 | | 12/2003 | Horton et al. | |

FOREIGN PATENT DOCUMENTS

| | | | | | |
|---|---|---|---|---|---|
| DE | 10350154 | B3 | * | 4/2005 | B21D 26/02 |
| DE | 102004028078 | A1 | * | 1/2006 | B21D 26/02 |
| DE | 10 2006 028 775 | | | 12/2007 | |
| EP | 0 995 513 | | | 4/2000 | |
| EP | 1 852 196 | | | 11/2007 | |
| WO | 03 099485 | | | 12/2003 | |

* cited by examiner

METHOD FOR OBTAINING AN OPENING IN A HOLLOW-BODY MEMBER, AND A HOLLOW-BODY MEMBER PROVIDED WITH ONE OR MORE OPENINGS OBTAINED WITH SAID METHOD

TECHNICAL FIELD OF THE INVENTION

The present invention refers to a method for obtaining an opening in a hollow-body member, and to a hollow-body member having a longitudinal extension and provided with one or more openings obtained with the above-mentioned method; the hollow-body member can consist of a tube of cylindrical or polygonal cross section, and therefore open at one or both ends, of a fluid connector bolt, and therefore open at one end and closed by the bolt head at the opposite end, or to similar members. The openings obtained with the method hereof may be arranged both on an axis substantially transversal to the longitudinal extension of the hollow-body member and on an axial direction.

STATE OF THE ART

A presently well-known method is to provide one or more openings in internally hollow cylindrical members by means of mechanical machining processes, generally milling, drilling o punching operations, which have the drawback of requiring subsequent restart operations to eliminate the cutting burrs that inevitably form during such operations, in particular on the inside walls of the cylindrical member due to the fact that the cutting direction is from outside toward the inside of such member. The subsequent restart and surface finishing operations are therefore rather difficult, as the tools are required to operate inside the cylindrical member. The requirement of making the edge of such openings as smooth and even as possible is dictated mainly by the need to avoid the possible subsequent detachment of metal particles which, if the hollow member is to be used in a pneumatic or hydraulic circuit, could damage other components in the circuit; in addition, still in the case of using the hollow-body member in the circulation of fluids, any discontinuities on the edge of the openings could hinder the smooth flow of the fluid, thus creating turbulence causing considerable pressure drop, or at least an irregular operation of the circuit.

A well-known method also consists of forming openings on a cylindrical member through punching operations. One example of making openings by punching in an internally hollow cylindrical member is provided by the Italian Patent Application No. PN2008A000095 in the name of the present applicant, which refers to the production of a connector bolt for fluids, in particular oil, known in the art by the term "banjo", provided with an internal fluid passage cavity and formed by known material deformation procedures, such as cold forging; the openings on the cylindrical wall through which the internal cavity communicates with the outside environment, or with a hydraulic circuit, are produced with a through punching process from the outside so as to cut out, in the punching area, a slug that spontaneously falls inside the cavity in the bolt.

However, the procedure described in said patent application is not without drawbacks: in the first place, an additional restart procedure is necessary to eliminate the cutting burrs of the slug inside the cylindrical wall, with the difficulties already pointed out above.

Moreover, to guarantee the complete detachment of the slug from the wall, it is necessary to reduce the thickness of the cylindrical wall of the bolt, thus also lowering its mechanical strength during the punching phase; in fact, the method provides that, to avoid the risk of causing permanent deformations due to the reduced wall thickness, a wall-reinforcing member is inserted in the bolt cavity to act as a sort of "anvil"; however, this reinforcing member cannot, for obvious reasons, be inserted as far as the punching area, and therefore the risk remains of causing permanent deformations in the bolt.

Another serious drawback lies in the risk that the slug or slugs cannot always be expelled with certainty or, even more serious, that they do not detach completely from the wall, so it may happen that they will be carried in the flow of the circulating fluid, creating serious risks in the circuit, like the possibility of clogging the circuit.

Naturally, it is possible to provide particular additional devices or additional operating procedures to assure the expulsion or the detachment of the slugs, as well as to make up for any deformations that may be caused by the reduced thickness of the bolt walls; however, such devices and/or operating procedures lead to increased costs of production of the bolt, so that this method could no longer be not more economically convenient.

SUMMARY OF THE INVENTION

The main task of the subject matter of the present invention is to devise a method of making an opening in a hollow-body member, as a hollow-body member having a longitudinal extension and provided with one or more openings formed with the same method, capable of resolving the problems resulting from the above well-known methods.

In the scope of the above task, a purpose of the present invention is to develop a method that does not require subsequent restart or finishing operations on the internal walls of the hollow-body member surrounding the openings.

Another objective is to devise a method whereby it is possible to obtain an edge on the openings as smooth and even as possible without requiring additional machining processes, save for any easily applicable surface finishing work on the outside walls.

One still other objective is to devise a method that does not lead to the formation of burrs on the walls of the hollow-body member, in particular on the inside walls, resulting from the formation of the openings.

A further objective is to devise a method in which the strength of the hollow-body member need not be compromised to facilitate the formation of the openings.

Still another objective is to devise a method to assure the complete and uniform detachment from the cylindrical walls of the wall portions removed to create the openings, as well as their complete and safe expulsion from the hollow-body member.

A further objective is to devise a method in which the formation of the openings on the hollow-body member does not require the use of particular devices or additional equipment with respect to those normally provided, and thus does not involve additional production costs resulting from such devices and/or equipment.

A not unimportant objective is to devise a method for obtaining an opening in a hollow-body member, as well as a hollow-body member provided with one or more openings obtained with said method, that achieves the above-mentioned goals and objectives at competitive costs and can be implemented with the usual and well-known plants, machines and equipment.

The above-mentioned goals and objectives, and others that will be further evidenced below, are achieved with a method for obtaining an opening in a hollow-body member as defined in claim 1.

BRIEF DESCRIPTION OF THE DRAWINGS

Additional characteristics and advantages of a method according to the present invention will become more evident from the following description of a particular, but not exclusive, embodiment illustrated purely by way of example but without limiting intents with reference to the following drawings, in which.

DETAILED DESCRIPTION OF THE INVENTION

Figure 1:
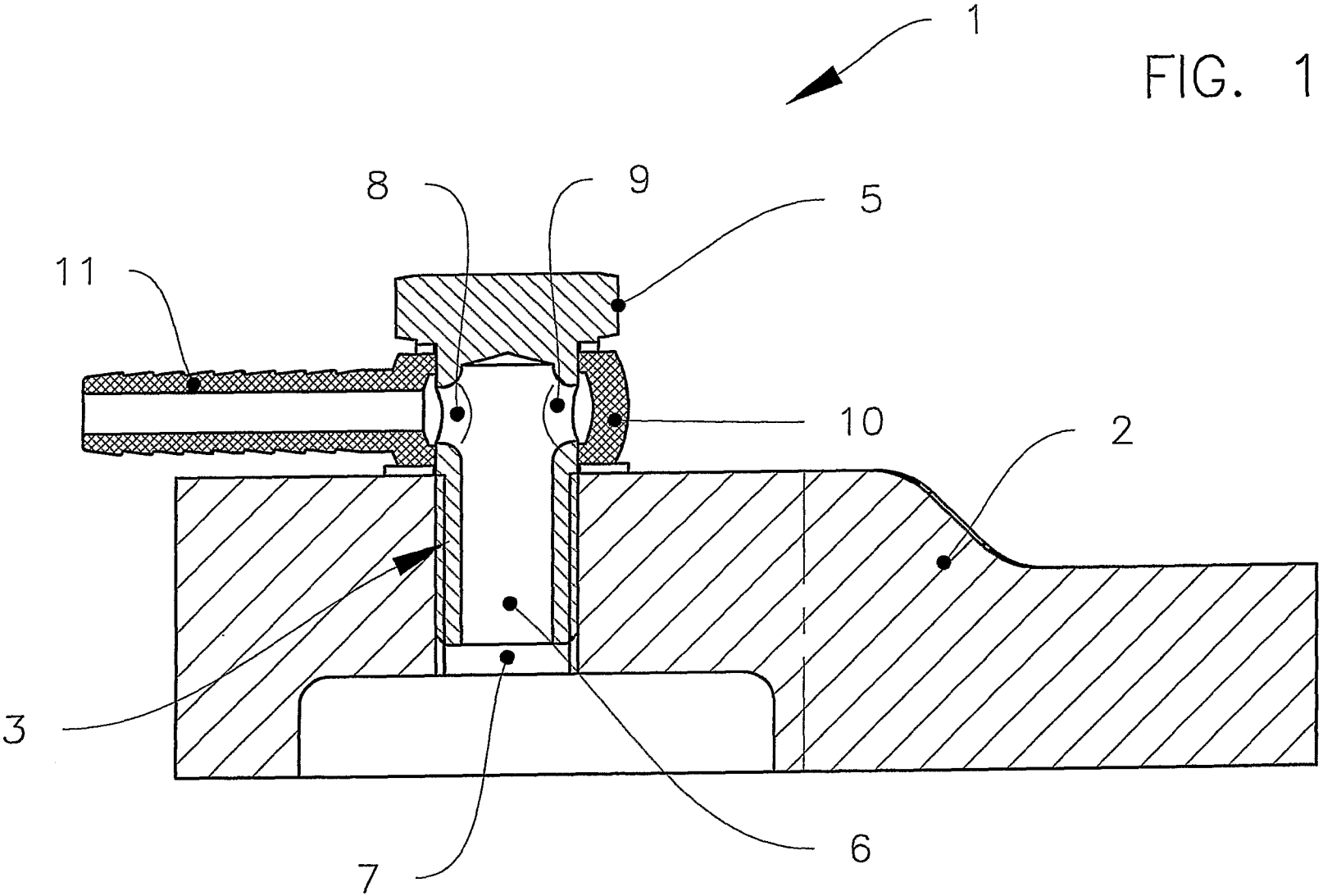
FIG. 1 illustrates, in an axial cutaway view, a hollow-body member provided with one or more transversal openings obtained through a method according to the present invention applied, by way of example, to a connector for fluids.

The following description refers partly, for convenience of disclosure, to the applicative example shown in FIG. 1, in which the hollow-body member is a bolt of cylindrical cross section, although it is understood that the method according to the present invention is generally applicable to obtain a hollow-body member that may consist of a tube of cylindrical or polygonal cross section, which may have cross sections of different diameters along its longitudinal extension, open at one or both ends and suitable for a range of different applications.

With reference to the enclosed figures, numeral 1 refers to a connector for fluids including a support holder 2 on which is mounted a hollow-body member 3 consisting, in this specific case, of a bolt including a partially threaded body 4, a head 5 and a cavity 6 open toward the outside at one end 7 of the body 4; such a type of bolt is known in the oil-hydraulics field as "banjo bolt". The connection between the bolt 3 and the holder 2 is by means of the threads on the body 4 that are screwed on an internal thread provided on the vessel 2.

On the body 4 are created, through the method that will be better explained below, one or more through openings 8, 9 set transversal to the longitudinal extension of the bolt 3 and suitable for communicating the cavity 6 with the outside environment or with a fluid circulation duct.

The bolt 3 is inserted, previously to its being mounted on the holder 2, in an internally hollow eyebolt 10 provided with a duct portion, or a connecting member for a duct portion, indicated with numeral 11, in communication with the cavity 6 through the openings 8, 9; an eyebolt of this type is known in the oil-hydraulics field as "banjo".

The method for obtaining the openings 8, 9 in the bolt 3, and more generally for obtaining a transversal opening in a hollow-body member open at least at one end, is carried out as follows, with reference to FIG. 3: the body 4 of the hollow-body member 3 on which will be created the transversal opening is inserted in a corresponding seat 17 of a holding die 12; the seat 17 has a cross section that is countershaped with respect to the cross section—cylindrical or polygonal—of the body 4 it is designed to receive. The holding die 12 includes an ejection channel 13 having a first end 18 communicating with the seat 17, when the hollow-body member 3 is not inserted, and a second ejection end 19, advantageously communicating with the outside environment. The first end 18 of the channel 13 communicating with the seat 17 is positioned at a portion of the wall of the hollow-body member 3 where the transversal opening is to be formed and has a cross section that substantially corresponds to the shape of the opening to be created; a clamping member 14 blocks the hollow-body member 3 in the seat 17 of the die 12.

The cavity 6 of the hollow-body member 3 is at least partially filled with an incompressible fluid, preferably oil introduced through the lubrication and/or cooling circuit, and subsequently a piston 15 is inserted through the open end 7; this substantially forms a cylinder-piston system in which the cylinder is made up of the walls of the hollow-body member 3 and the compression chamber is defined by the cavity 6.

The phases of the procedure are schematically illustrated in a simplified manner (the clamping member 14 is not shown) in FIGS. 4*a* to 4*d*, to which reference is made below. In the first step (FIG. 4*a*), the hollow-body member 3 is inserted into the relative seat 17 in the die 12 provided with the ejection channel 13, whose first end 18 is positioned in correspondence with the portion of the wall on which the transversal opening is to be formed. Once the hollow-body member 3 is positioned and clamped in the seat 17, the cavity 6 is progressively filled with incompressible fluid. The piston 15 is then inserted inside the cavity 6 (FIG. 4*b*) and progressively compresses the fluid contained in the same cavity 6, generating a progressively increasing pressure acting against the internal walls of the hollow-body member 3. The deformation of the hollow-body member 3 due to the compression generated in this manner is prevented by the walls of the seat 17 in the die 12, with the exception of the wall portion on which the opening is to be produced, where the deformation is allowed by the presence of the ejection channel 13. This wall portion begins to deform accordingly until the pressure of the fluid inside the cavity 6 reaches a "bursting" point that causes a sudden detachment of a wall portion 16 (FIG. 4*c* or FIG. 3) having a shape that substantially corresponds with the cross-sectional shape of the first end 18 of the channel 13 that was initially in contact with the hollow-body member 3. As a consequence of the pushing action of the fluid under pressure, the wall portion 16 is expelled along the ejection channel 13 (FIG. 4*d*) to the outside of the hollow-body member 3 toward the second end 19 of the ejection channel 13. In the preferred case in which the second end 19 puts the ejection channel 13 in communication with the exterior environment, as shown by way of example in the attached figures, the wall portion 16 is expelled outside the die 12.

Figure 5:
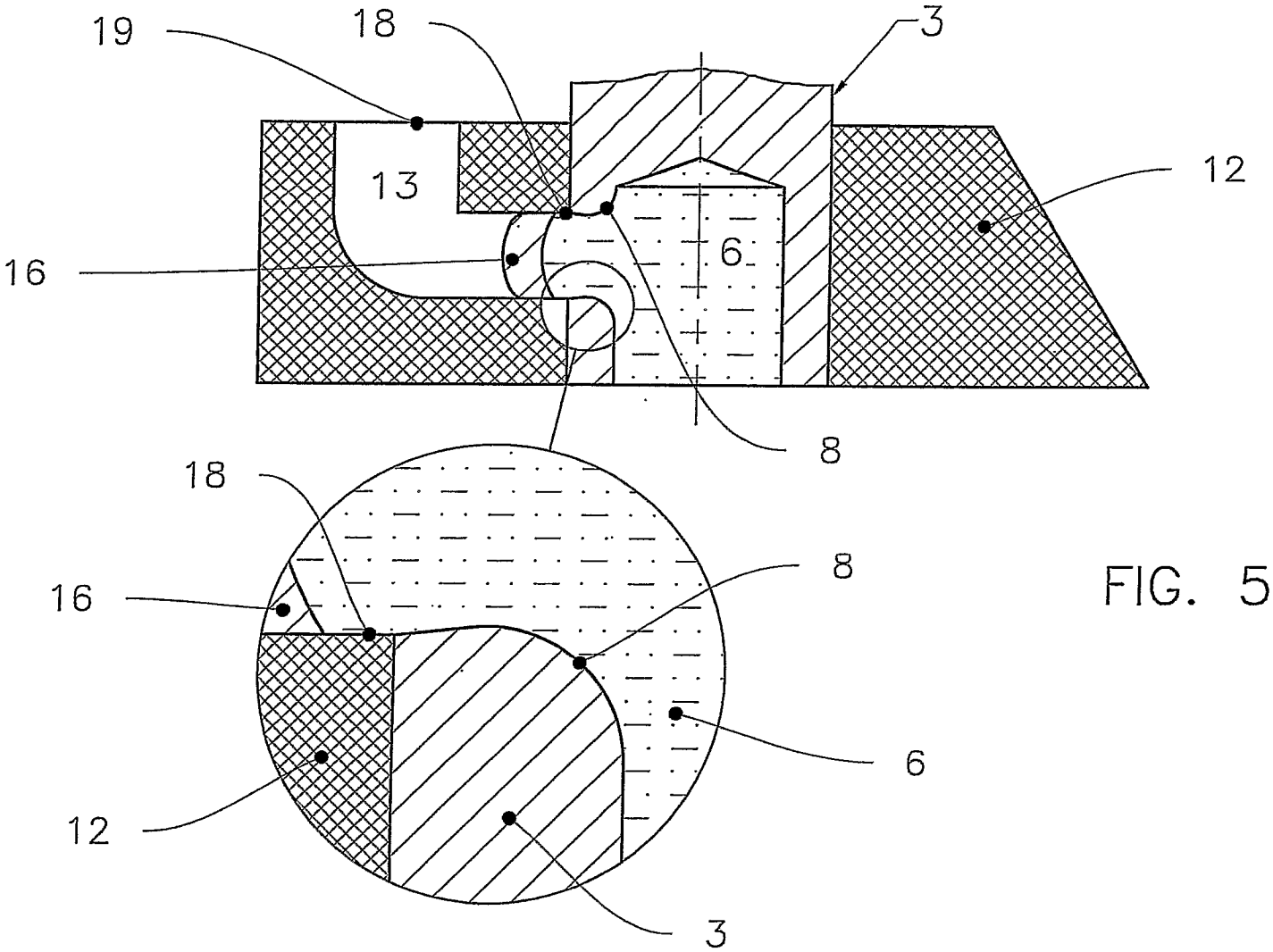
FIG. 5 is an enlarged detail of FIG. 4*d;*

By this method, an opening 8 is produced in the position and in the shape required, and set transversally to the longitudinal extension of the hollow-body member 3. As a result of the first slow deformation phase and of the subsequent abrupt outward separation of the wall portion 16 from the hollow-body member 3, which effectively takes place in an explosive "burst", the edges of the opening 8 turned toward the cavity 6, and therefore toward the inside of the hollow-body member 3, are smooth and rounded as shown schematically in FIG. 5, without showing the burrs that are generally found on such internal edges formed with the conventional mechanical methods of cutting the wall portion 16, caused by the cutting direction of the hollow-body member 3 inwardly from the outside, and the elimination of which is rather difficult.

Any burrs of material present on the external wall of the hollow-body member 3 can be easily and quickly eliminated through simple known surface finishing procedures, such as for example a tumbling operation.

Figure 2:
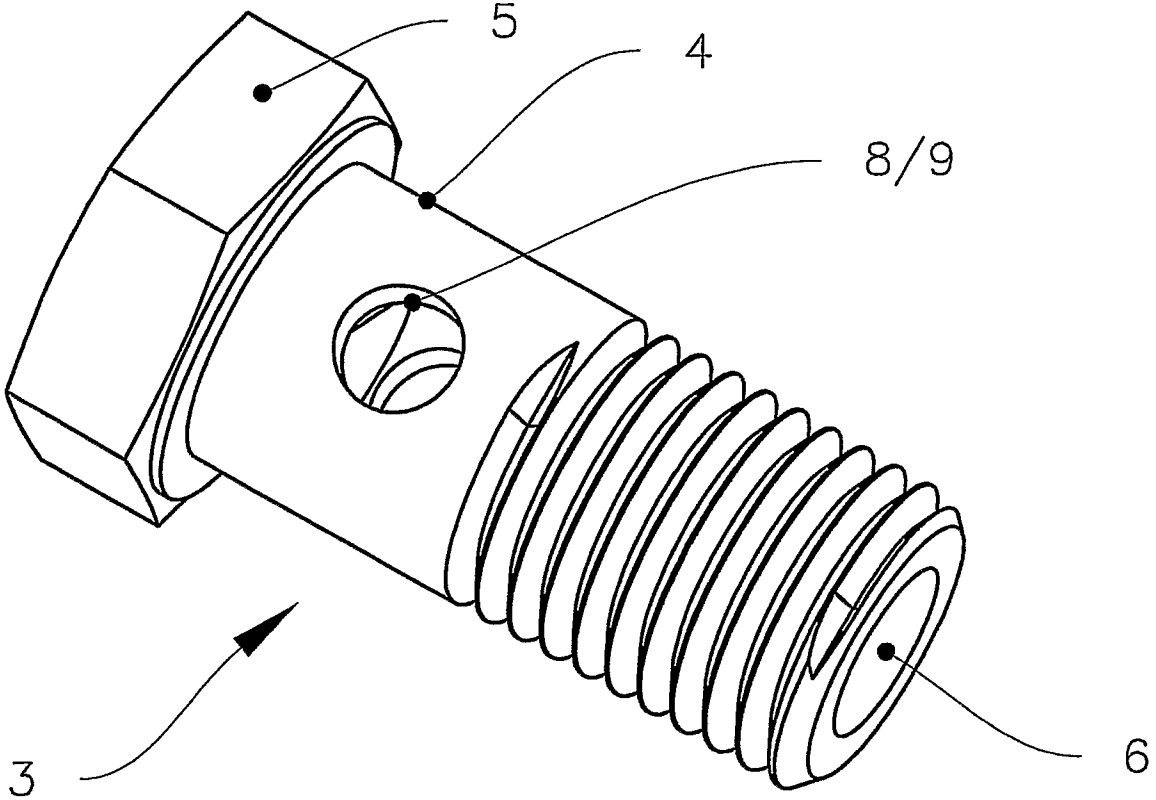
FIG. 2 shows, in a perspective view, the hollow-body member of FIG. 1, comprised by way of example of an internally hollow cylindrical bolt provided with one or more openings arranged transversally to the longitudinal axis.
Figure 7:
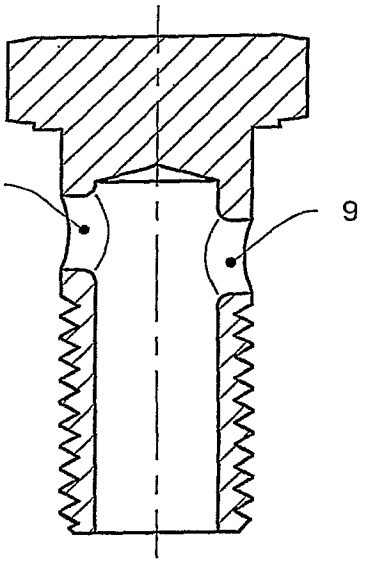
FIG. 7 shows a different arrangement of the openings that can be obtained along the hollow-body member through the method of the present invention.

Naturally, the method described above can be repeated a number of times to produce more openings, set coaxially along an axis transversal to the longitudinal extension of the cylindrical member 3, as exemplified in the bolt shown in FIGS. 1 and 2 with reference to the two openings 8 and 9, or set on different transversal axes, as exemplified in FIG. 7 with reference to the two openings 8' and 9'.

With the method according to the present invention there is also a wide margin of freedom regarding the reciprocal angular positioning of the openings along the hollow-body member 3, since the location of the openings is not necessarily limited to facing positions, on the same axis or on axes offset as described above, but it is also possible to produce openings whose respective axes, either coplanar or on different planes, are set at different angles to each other.

Figure 3:
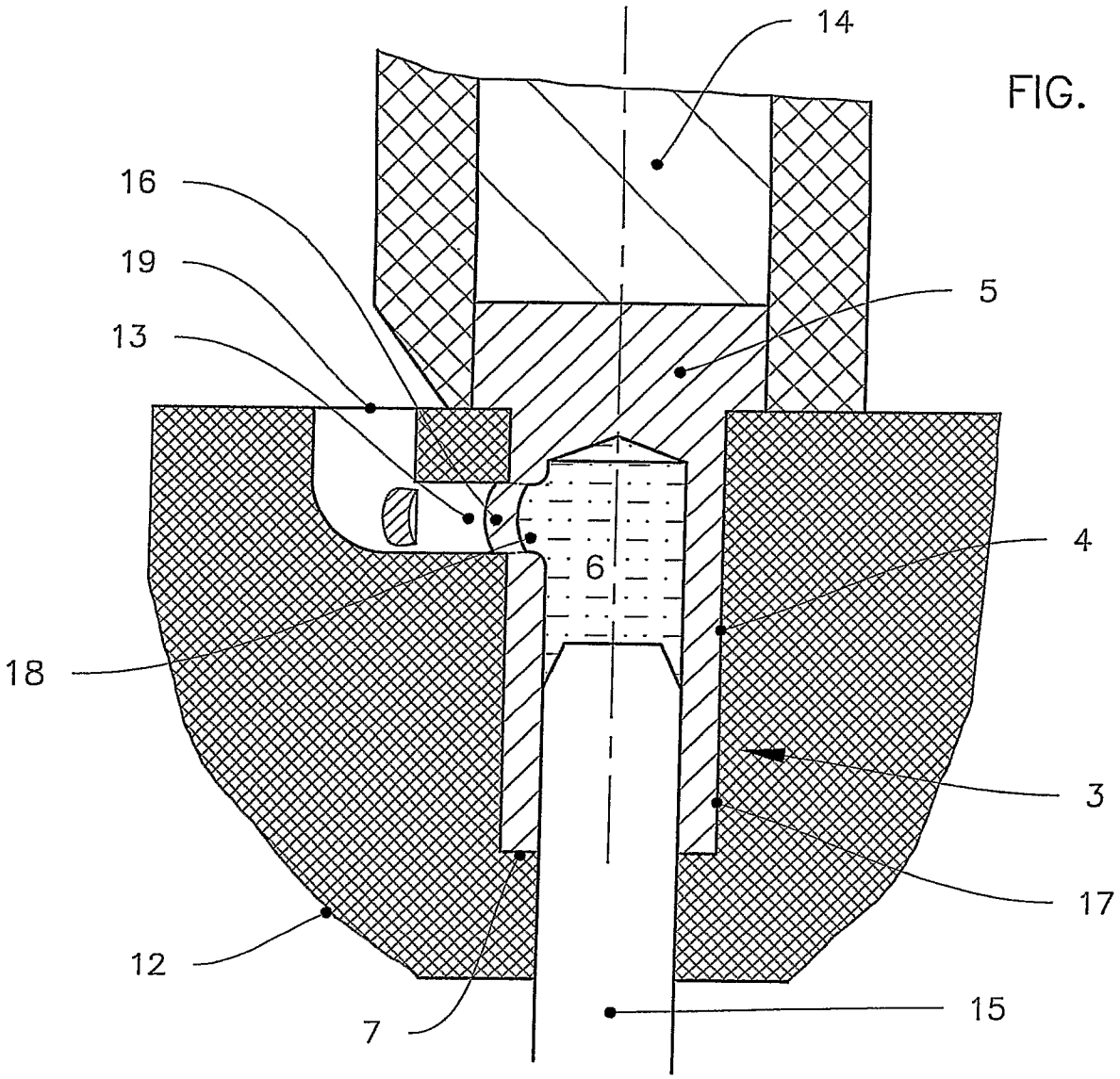
FIG. 3 illustrates schematically a phase of the method according to the present invention.
Figure 4A:
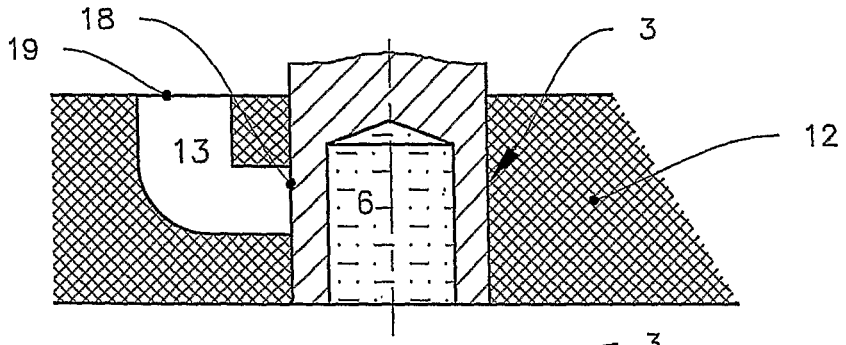
FIGS. 4*a* to 4*d* illustrate schematically the sequence of phases of the method according to the present invention.
Figure 4B:
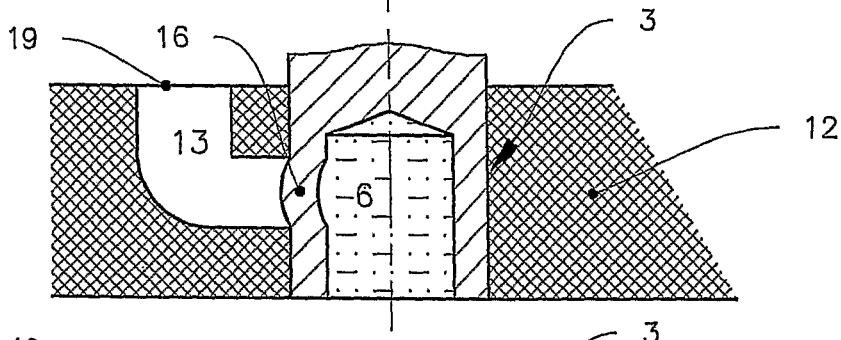
Figure 4C:
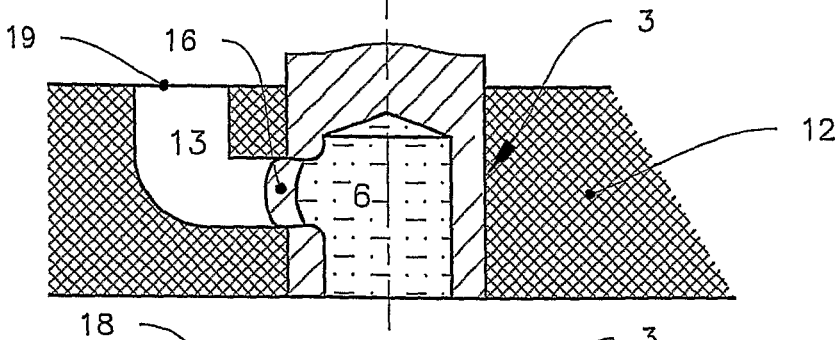
Figure 4D:
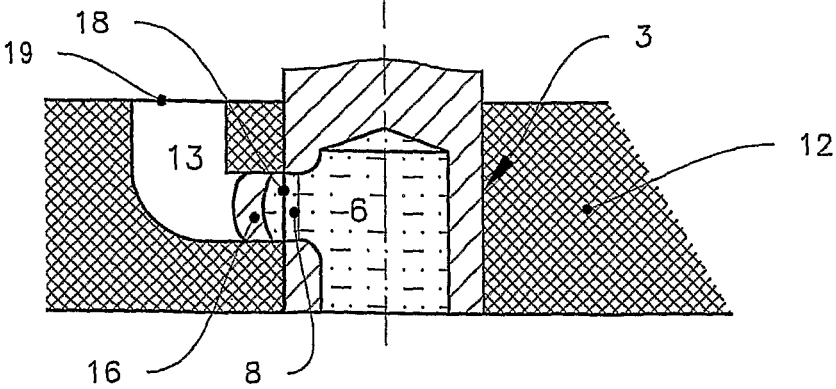

In the diagram of FIG. 3, the hollow-body member 3 is open at one end 7 while at the opposite end there is a head 5 that hermetically closes the cavity 6 where the fluid is let in. Naturally, the method according to the present invention can also be applied to obtain one or more openings in a hollow-body member open at both ends; in this case, the clamping member must also serve the function of hermetically sealing the upper end of the hollow-body member, or a suitable hermetically sealing plug can be provided to be applied at the upper end of the hollow-body member.

FIGS. 6*a* to 6*d* illustrate some of the possible shapes of the openings than can be obtained, in addition to the normal circular shape, with the method described above; it is in fact sufficient to vary the cross section of the first end 18 of the channel 13 to obtain an opening with a shape that is substantially equal to the shape of said cross section.

Figure 6D:
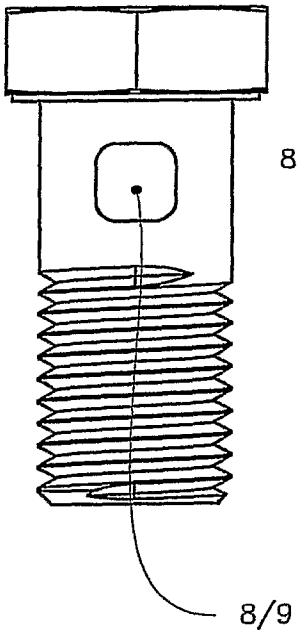
FIGS. 6*a* to 6*d* illustrate some of the possible shapes of openings that can be obtained in a hollow-body member through the method of the present invention.
Figure 6C:
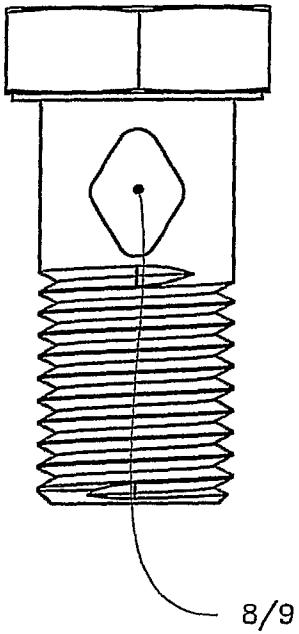
Figure 6B:
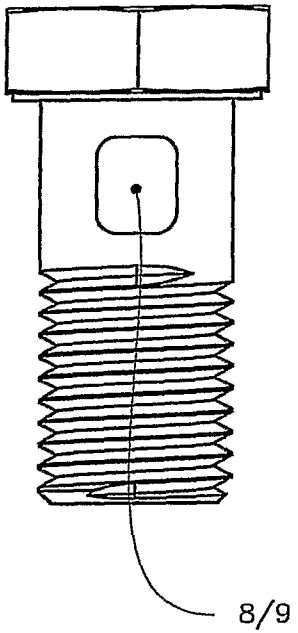
Figure 6A:
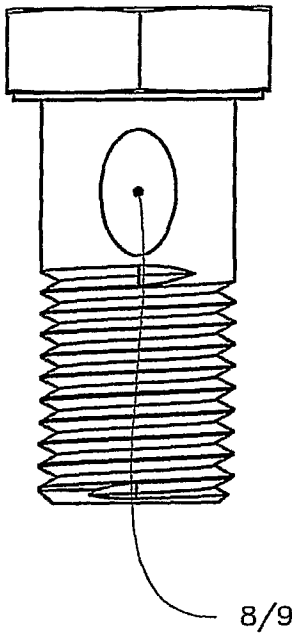
Figure 8C:
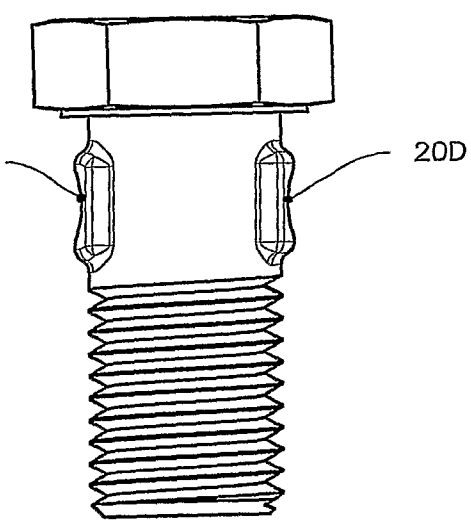
FIGS. 8*a* to 8*d* illustrate, respectively, in a cutaway view, a front elevation, a side elevation and a perspective view, a further form of hollow-body member provided with openings obtainable with a method according to the present invention.
Figure 8B:
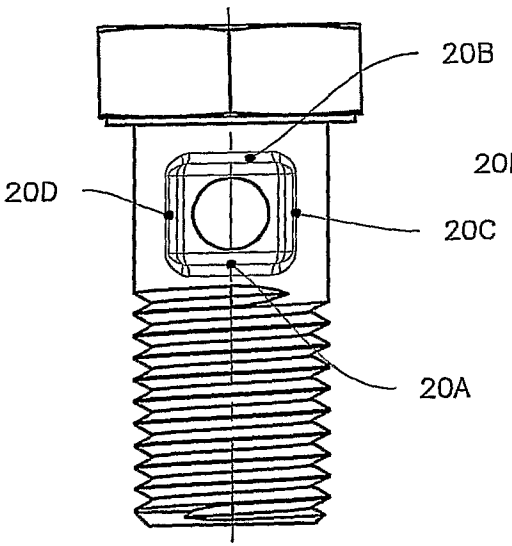
Figure 8D:
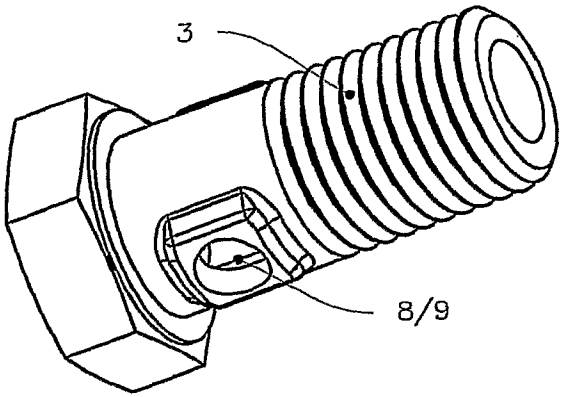
Figure 8A:
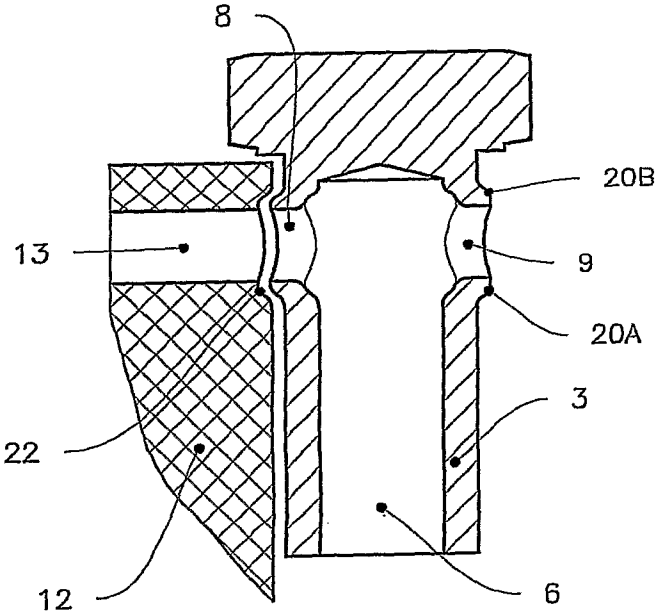
Figures 9A, 9B, 9C, 9D:
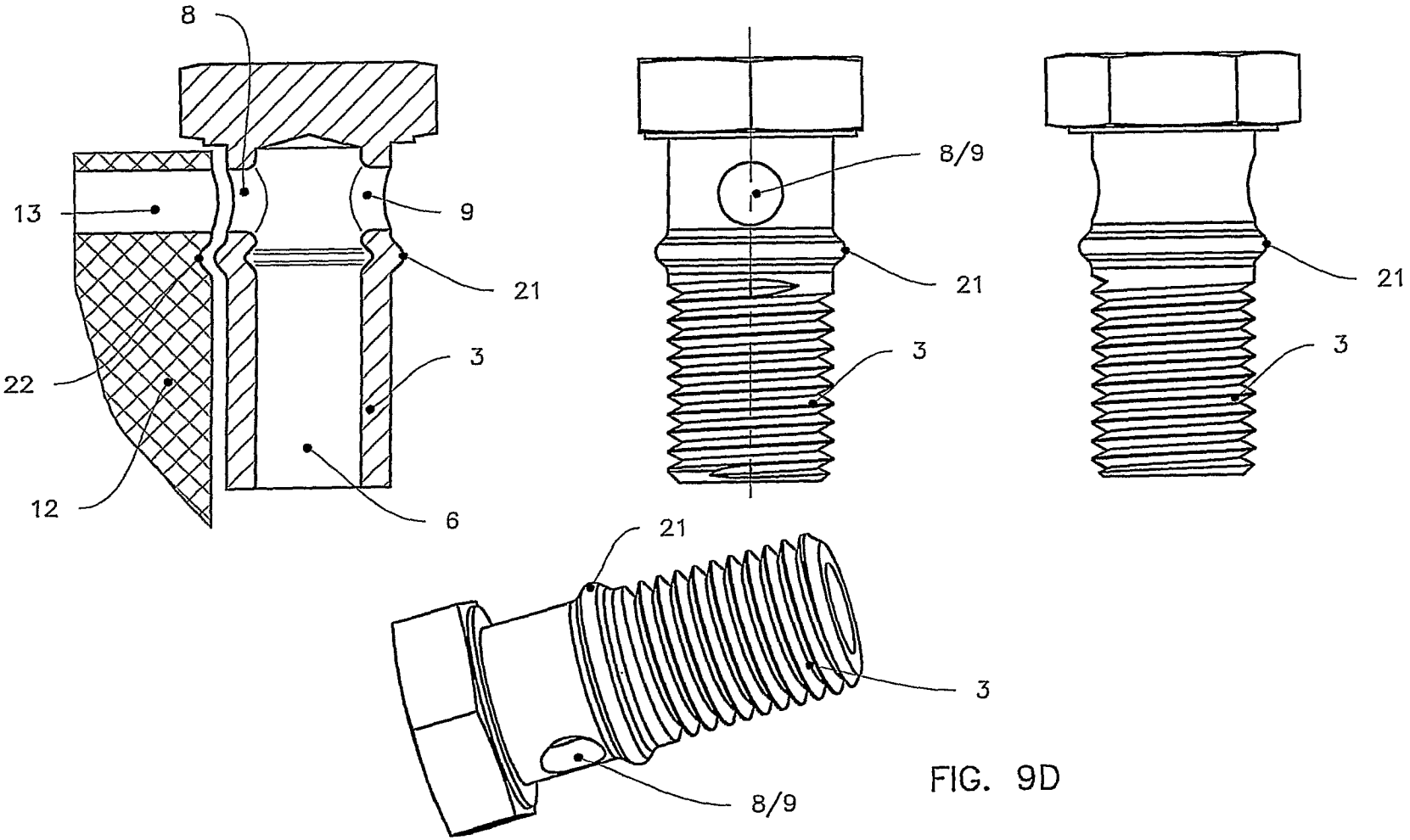
FIGS. 9*a* to 9*d* illustrate, in views similar to the previous ones, another different form of a hollow-body member provided with openings obtainable through a method according to the present invention.

Some preferable shapes for the opening, particularly if it is to be used as a cross section for the passage of a fluid, are the rectangular cross section and the square cross section with rounded edges, as exemplified in FIGS. 6*b* and 6*d*; in fact these cross sections make it possible to have, for the same flow-resistance cross section, a greater flow rate; and therefore cross-sectional values for an optimal flow-resistance/flow-rate ratio.

A further feature of the method according to the present invention lies in the fact that it is particularly easy to form undercuts in one or more portions of the body 4, preferably adjacent to the opening 8 and/or 9 as exemplified in the FIGS. 8*a* to 8*d* and 9*a* to 9*d*, otherwise obtainable with complex insert dies or costly stock-removal machining. Such undercut portions, indicated with the reference numerals 20A, 20B, 20C and 20D in the embodiment of FIGS. 8*a*-8*d* and with numeral 21 in the embodiment of FIGS. 9*a*-9*d*, can include a frame 20A-20D projecting around the opening 8 and/or 9, or one or more annular ridges 21 projecting perimetrically around the body 4 and preferably adjacent to the opening 8 and/or 9, as in the embodiment of FIGS. 9A-9D, or partial, combined or equivalent forms of the same. The production of such undercut portions is obtained through a suitable shaping of the seat 17 in the die 12, in which recessed areas 22 will be formed at one or more regions preferably adjacent to the first end 18 of the ejection channel 13 communicating with the seat 17; in this manner, during the deformation phase, the pressure exerted by the incompressible fluid also causes the controlled deformation of said regions until they come into contact with the corresponding recessed areas 22 of the seat 17 in the die 12, which prevent further deformation and therefore avoid causing the detachment of the portions of the body 4 involved in the undercut.

Figure 10:
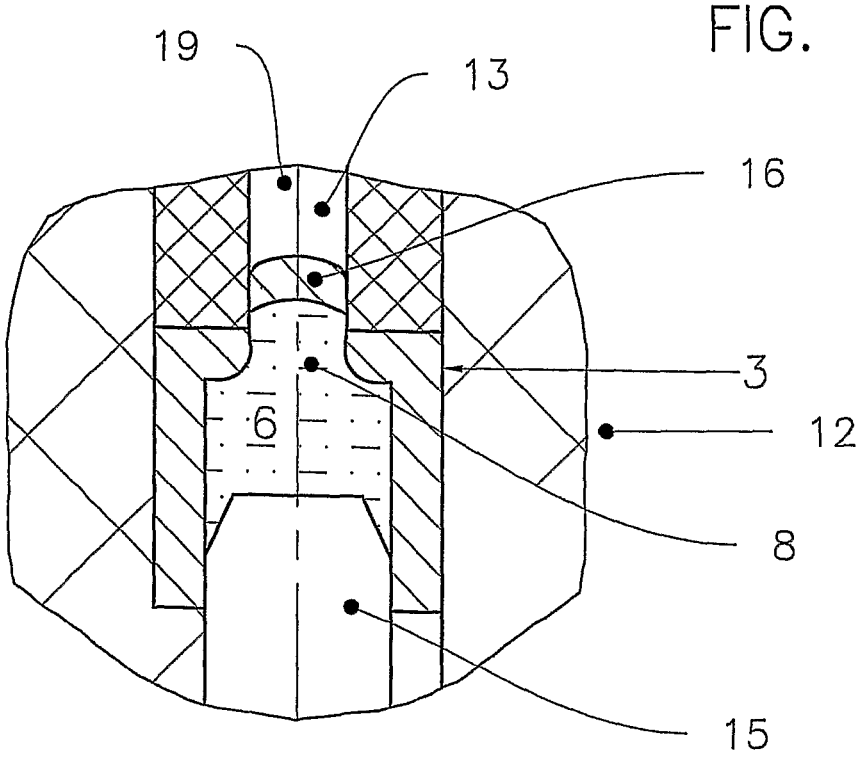
FIG. 10 illustrates schematically the application of the method of the present invention to obtain an axially oriented opening at the longitudinal extension of the hollow-body member.
Figure 11:
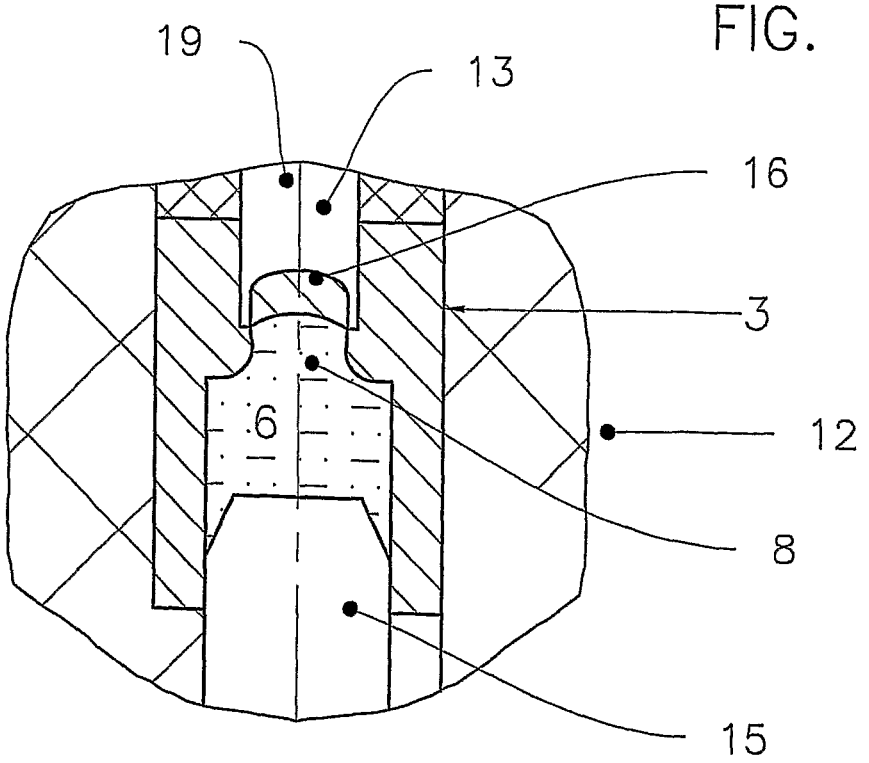
FIG. 11 illustrates the method as in FIG. 10 previously applied to a different form of hollow-body member.

The method according to the present invention is not limited to obtaining an opening arranged on an axis approximately transversal to the longitudinal extension of the hollow-body member 3, as described to this point, but is also applied to obtaining an opening 8 set at an axial direction, as shown schematically in FIGS. 10 and 11, in which the channel 13 in the die 12 has an axial instead of a transversal orientation, with respect to the longitudinal axis of the hollow-body member 3. In this case, the opening 8 is obtained at the bottom of the cavity 6 instead of on a longitudinal wall of the member 3. As will be evident to a person who is expert in the field, the steps in the method are also the same in this different arrangement, where the reference numerals have been maintained the same to indicate the same members, even if arranged differently.

The method according to the present invention can also be conveniently integrated in a cold-deformation process in a transfer line for the production of the hollow-body member 3, preferably of the type in which the cavity 6 is closed at one end by a head 5. The cold-deformation process may include, for example, a drawing operation to obtain the internal cavity 6 of said member 3 and a subsequent operation for obtaining an opening in the cavity 6 through the method according to the present invention, and then adding a suitable quantity of incompressible fluid into the cavity 6 put under pressure by the subsequent insertion of the piston 15 that causes the deformation and the detachment of the wall portion 16 to form the opening on the body 4 of the member 3 as already described.

From the above description, it is evident how the present invention achieves the objectives and the advantages initially aimed at: in fact, a method has been devised for obtaining an opening in a hollow-body member, as well as a hollow-body member provided with one or more openings obtained with said method, capable of overcoming the drawbacks resulting from the known methods mentioned in the preamble of the present description.

The above described method makes it possible, in fact, to produce an opening in a hollow-body member without requiring subsequent, and difficult, restart or finishing operations on the internal walls of the hollow-body member surrounding the openings. In addition, the smoothness and evenness of the edges on the openings obtained by this method are optimal without requiring additional mechanical processes, save for any easily applicable surface finishing work on the outside walls. As has been shown, in fact, the internal edges of the openings formed with the procedure according to the present invention are perfectly rounded and free of burrs, thanks to the process of initial deformation of the internal wall of the hollow-body member 3 and to the subsequent burst that expels the wall portion 16 along the ejection channel 13.

A further advantage of the method according to the present invention consists of the fact that the strength of the hollow-body member 3 is not compromised, as it is not necessary to reduce the thickness of the walls of the member 3 to make it easier to create the openings or to avoid the formation of burrs.

One other advantage of the method lies in the fact that the detachment of the wall portion 16 and its expulsion from the hollow-body member 3 are ensured in a complete and even manner, thus eliminating the risk that a section of such wall portion 16 remains attached to the edge of the opening or that the same wall portion 16 remains trapped in the cavity 6 of the hollow-body member 3.

It is here pointed out how the method can be implemented by means of simple equipment, consisting essentially of the holding die 12 and the clamping member 14, without requiring the use of particular devices or additional equipment with respect to those designed for to create the openings; the method is thus economically and productively favourable, as it does not require additional production costs resulting from particular devices and/or additional equipment.

It is further pointed out that the method according to the present invention allows a wide margin of freedom regarding the reciprocal positioning and the shape of the openings, as it is possible to produce openings of different shapes by simply varying the cross section of the first end 18 of the channel 13, and openings that are positioned facing each other, on the same transversal axis or on more different axes, or set at an angle to each other by simply varying the position of the hollow-body member 3 with respect to the first end 18 of the channel 13.

A further advantage of the method according to the present invention consists of its relative simplicity, easiness and economic convenience with which it is possible to produce undercut portions 20A, 20B, 20C, 20D, 21, preferably arranged near the openings 8, 9, otherwise obtainable with costly and complex processes and equipment.

The method can also be easily and conveniently integrated in a cold-deformation process in a transfer line for obtaining the hollow-body member 3, preferably of the type in which the cavity 6 is closed at one end by a head 5, optimizing the production cycle without requiring subsequent restart operations.

Naturally, the present invention is amenable to many applications, modifications or variants without departing from the scope of protection as defined by the independent claim 1.

In addition, the materials and equipment used to implement the present invention, as well as the shapes and dimensions of the individual components, can be the most suitable in relation to the specific requirements.

The invention claimed is:

1. A method for obtaining an opening in a hollow-body member having a longitudinal extension and a cavity, comprising:

predisposing a holding die including a seat countershaped with respect to said hollow-body member and an ejection channel having a first end communicating with said seat and a second end for ejection;

inserting and positioning said hollow-body member in said seat so that said first end is arranged in correspondence with a portion of a wall of said hollow-body member on which to obtain an opening;

inserting a piston inside said cavity to compress an incompressible fluid with which said cavity is at least partially filled; and progressively increasing pressure inside said cavity sufficient to deform said wall portion to a point of detaching the wall portion from said hollow-body member to form said opening without burrs, and expelling said wall portion along said ejection channel, wherein one end of the cavity is open, an opposite end of the cavity is hermetically closed by a head of the hollow-body member, and a flange of the head rests on an outside surface of the holding die after the inserting and positioning said hollow-body member in said seat.

2. The method of claim 1, wherein a direction of the deforming, the detaching and the expelling of said wall portion is oriented from inside said cavity toward an outside of said hollow-body member.

3. The method of claim 1, wherein the edges of said opening oriented toward said cavity, which is toward the inside of said hollow-body member, are smooth and rounded.

4. The method of claim 1, wherein said first end of said ejection channel has a cross section that substantially matches a shape of said opening to be obtained.

5. The method of claim 1, further comprising blocking said hollow-body member in said seat by a clamping member.

6. The method of claim 1, wherein said second end of said ejection channel communicates with an exterior environment.

7. The method of claim 6, wherein said wall portion is ejected outside said holding die through said second end.

8. The method of claim 1, wherein the predisposing the holding die, the inserting and positioning said hollow-body member, the inserting the piston, and the progressively increasing the pressure are repeated a number of times to obtain a corresponding number of openings.

9. The method of claim 1, wherein said opening is arranged at an axis transversal to said longitudinal extension of said hollow-body member.

10. The method of claim 1, wherein said opening is axially oriented with said longitudinal extension of said hollow-body member.

11. The method of claim 1, wherein said seat is provided with one or more recessed areas near said first end of said ejection channel, to form during said progressively increasing the pressure one or more undercut portions projecting from said hollow-body member.

12. The method of claim 1, wherein the method is performed in a cold-deformation process in a transfer line for producing said hollow-body member.

13. The method of claim 1, wherein the expelling said wall portion includes expelling the wall portion by the pressure inside the cavity into an unobstructed ejection channel in the holding die when the wall portion detaches from said hollow-body member.

14. The method of claim 1, further comprising at least partially and progressively filling said cavity with the incompressible fluid after the inserting and positioning said hollow-body member in said seat.

15. The hollow-body member obtained through the method of claim 1, comprising: one or more openings arranged transversely along the longitudinal extension of said hollow-body member.

16. The hollow-body member obtained through the method of claim 11, comprising: one or more undercut portions projecting from said hollow-body member and adjacent to said opening.

17. The hollow-body member obtained through the method of claim 1, comprising: an opening axially oriented with the longitudinal extension.

18. The hollow-body member obtained through the method of claim 3, comprising: edges of said opening oriented toward the inside of said hollow-body member that are smooth and rounded.

* * * * *